United States Patent [19]

Hertz

[11] Patent Number: 4,535,741

[45] Date of Patent: Aug. 20, 1985

[54] FUEL METERING METHOD AND DEVICE

[75] Inventor: Carl H. Hertz, Skolbanksvagen 8, Lund, S-223 67, Sweden

[73] Assignee: C. Hellmuth Hertz, Lund, Sweden

[21] Appl. No.: 580,685

[22] Filed: Feb. 16, 1984

[51] Int. Cl.[3] ..... F02N 37/14; F02M 27/08

[52] U.S. Cl. ..... 123/444; 123/445; 123/530

[58] Field of Search ..... 123/530, 444, 445

[56] References Cited

U.S. PATENT DOCUMENTS 3,613,649 10/1971 Moss ..... 123/530
3,616,782 11/1971 Matsui et al. ..... 123/445
3,690,306 9/1972 Matsui et al. ..... 123/444
3,977,382 8/1976 Tuzson et al. ..... 123/445
4,211,196 7/1980 d'Orsay ..... 123/530

*Primary Examiner*—E. Rollins Cross
*Attorney, Agent, or Firm*—Richard J. Hammond

[57] ABSTRACT

A fuel supply control system for an internal combustion engine is disclosed. The system comprises a means connecting to an air control apparatus, regulating flow of air into the engine, at least one chamber in fluid communication with the cylinders of the engine fuel delivery means, the fuel delivery means terminating in an aperture such that said fuel, when forced through said aperture forms a continuous stream.

31 Claims, 25 Drawing Figures

FUEL METERING METHOD AND DEVICE

FIELD OF INVENTION

This invention relates to a method for directing the flow of a continuous stream of liquid under pressure and an apparatus therefor. More particularly, this invention relates to a method and apparatus for accurately delivering controlled amounts of a liquid to a receptor.

BACKGROUND OF THE INVENTION

In many technical processes it is necessary to meter fluids at high speeds with great accuracy. A typical example of this is the metering of fuel to an automobile gasoline-engine, where each cylinder is supposed to be supplied with an exact amount of fuel each time the air intake valve of that cylinder opens. The amount of fuel supplied to each cylinder depends on the status of the engine, i.e., it depends on the power the engine is delivering, its temperature, ambient air pressure etc. To ensure maximum engine efficiency and minimum air pollution by the exhaust gases, the air-fuel mass ratio entering each cylinder of the engine should be close to 14.5 at which ratio all fuel is burnt and all oxygen in the air is used. To meet these maximum conditions the amount of fuel in each fuel pulse delivered to each of the cylinders of the engine should be metered with an accuracy of plus or minus 1% or better. If a central metering element is supplying all cylinders of the engine at the same time, it is necessary that this accuracy be met for each of the cylinders and not only for all the cylinders together. If some of the cylinders get too much fuel and some too little, the engine will run inefficiently and produce unnecessary pollution. Thus, the equal distribution of the fuel between the cylinders is of great importance.

The correct amount of fuel to be metered to each cylinder in the form of pulses, one pulse for each cylinder firing, depends on engine power, air temperature, air pressure, throttle position, engine temperature and several other parameters. This amount can be determined by a microprocessor, the input of which is supplied by the above parameters. Normally the microprocessor outputs one electric pulse for each cylinder firing, the length of which is proportional to the amount of fuel to be metered. Hence the fuel metering element itself should be controllable by electrical signals. In a central metering device for a four cylinder engine the length of this pulse varies between 0.5 to 10 milliseconds and its repetition frequency varies between 5 to 200 pulses per second. These operation conditions are very demanding on mechanical endurance, reliability and long-term metering accuracy of the device.

A typical example of such a metering element is described in Bosch Technische Berichte 3, 1 (November 1969). Essentially it is a fast electromagnetic valve. It consists of a small nozzle to which the fuel is applied at about 100 kPa (1 atmosphere). On the fuel side the nozzle is closed by a cylindrical element made of iron, the face of which is pressed against the entrance to the nozzle by a spring. In this position no fuel can exit from the nozzle.

At the position of the cylindrical element the fuel line is surrounded by a solenoid. If a current is passed through this solenoid, the iron cylindrical element will be slightly retracted from its seat on the nozzle entrance so that fuel can pass through the nozzle. Thus by applying the pulse from the microprocessor, fuel will pass through the nozzle to the engine, the amount of which is proportional to the pulse length. Since the microprocessor issues one pulse for each engine firing, fuel can be metered to the engine in precise amounts.

If a four cylinder engine is supplied by one such metering device, the device will have to be operated up to 200 times a second. This puts a very heavy strain on some of the components of the device, e.g. the cylindrical element and the valve seat. As a result, these parts change slightly in shape with time which affects the metering accuracy of the device. This is especially true for short pulses (0.5–2 milliseconds) where it is difficult to attain the required accuracy even in new devices. Further, using one central metering device for all four cylinders of the engine it is difficult to distribute exactly the same amount of fuel through the manifold to each of the cylinders. If this is not attained with good precision, the engine runs inefficiently and causes air pollution. The same is true for engines where each cylinder is supplied through a separate fuel metering device if these devices differ in their metering accuracy due to wear or for other reasons. Finally, it should be mentioned that this type of fuel metering device is expensive to produce because of the close mechanical tolerances that have to be met to ensure the proper functioning of the device. For these reasons a new fuel metering device has been developed which circumvents the disadvantages mentioned above. This invention uses a continuous jet of fuel exiting from a nozzle under high pressure which is directed into a fuel return tube. By controlling the divergence of the jet, the amount of fuel missing the fuel return tube can be controlled.

It is therefore a primary object of this invention to provide an novel method of controlling the divergence of a continuous stream of liquid from the normal axis of the stream.

It is a further object of the present invention to provide an improved method for controlling the divergence of the continuous stream by controlling the amplitude of a periodic oscillating nozzle delivering the stream.

It is a further object of the present invention to provide a method of the character described to control the amplitude of the nozzle by use of an electric signal.

It is an additional object of the present invention to provide a method of the character described where the electric signal is one of alternating current or voltage.

It is a further object of the present invention to provide a method of the character described where at least a part of the continuous stream of liquid enters a receptor during each periodic oscillation of the nozzle.

It is another object of the present invention to employ this method to control the delivery of a continuous stream of liquid to a receptor by passing the continuous stream through an interceptor.

A fuller understanding of the nature and objects of the invention can be had by referring to the following detailed description of the preferred embodiments taken in connection with the accompanying drawings, in which:

FIG. 1*a* is a simplified perspective view of an embodiment of the apparatus of the present invention;

FIG. 1*b* illustrates the divergence of a liquid stream about a return tube mouth;

FIG. 1*c* illustrates the pattern of flow of the continuous liquid jet from the moving nozzle;

FIG. 2 illustrates an embodiment of the present invention incorporating electromechanical means to periodically oscillate the nozzle;

FIGS. 3*a*–3*c* illustrate the relationship of the current amplitude on the oscillation of the nozzle as a function of time;

FIGS. 4*a* and 4*b* illustrate a preferred embodiment of the present invention applied as a fuel metering apparatus in a gasoline-powered engine;

FIGS. 5*a* and 5*b* illustrate a further embodiment of the apparatus of FIG. 4*a* and 4*b;*

Figure 8:
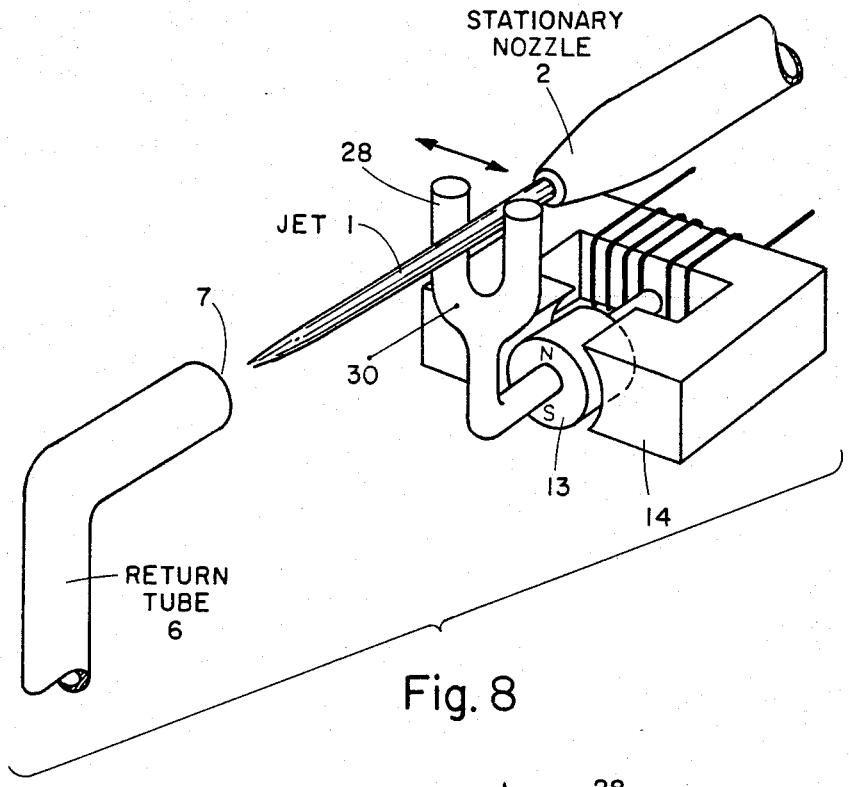
FIG. 8 illustrates a further embodiment of the method of the present invention.
Figure 8A:
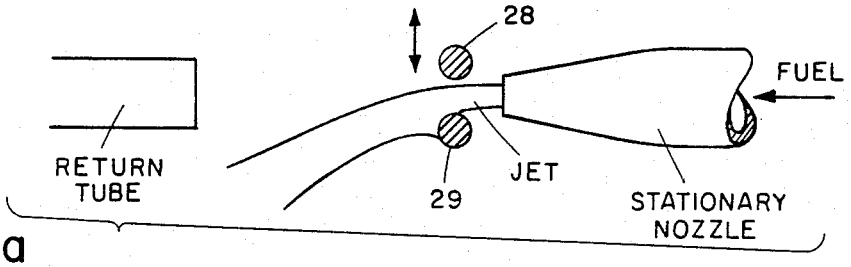
Figure 8B:
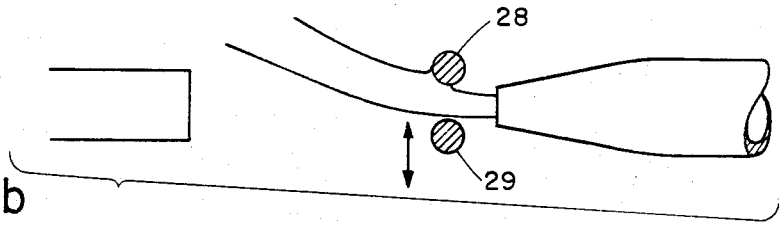
Figure 8C:
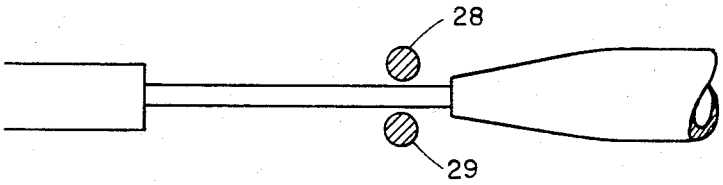

FIGS. 8*a*–8*c* are simplified cross-sectional views showing the principle of FIG. 8;

FIGS. 9*a*–9*d* are simplified cross-sectional views showing the principle of a further embodiment of this present invention.

Figure 10A:
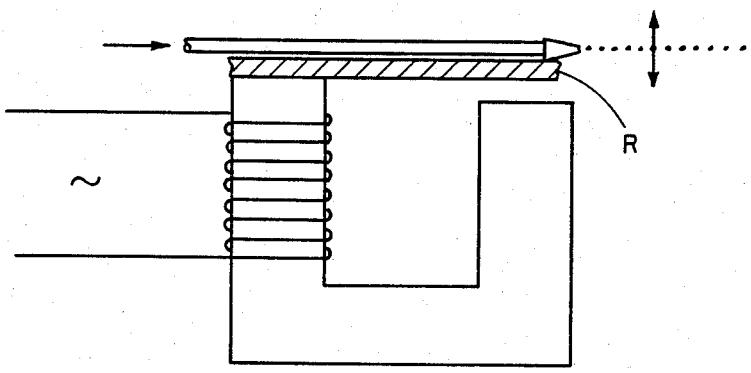
Figure 10B:
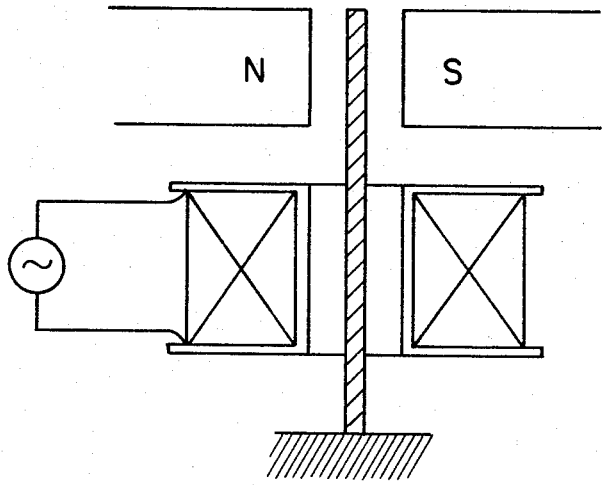

FIGS. 10*a*–10*b* illustrate embodiments of devices that will cause nozzle oscillations.

Figure 11:
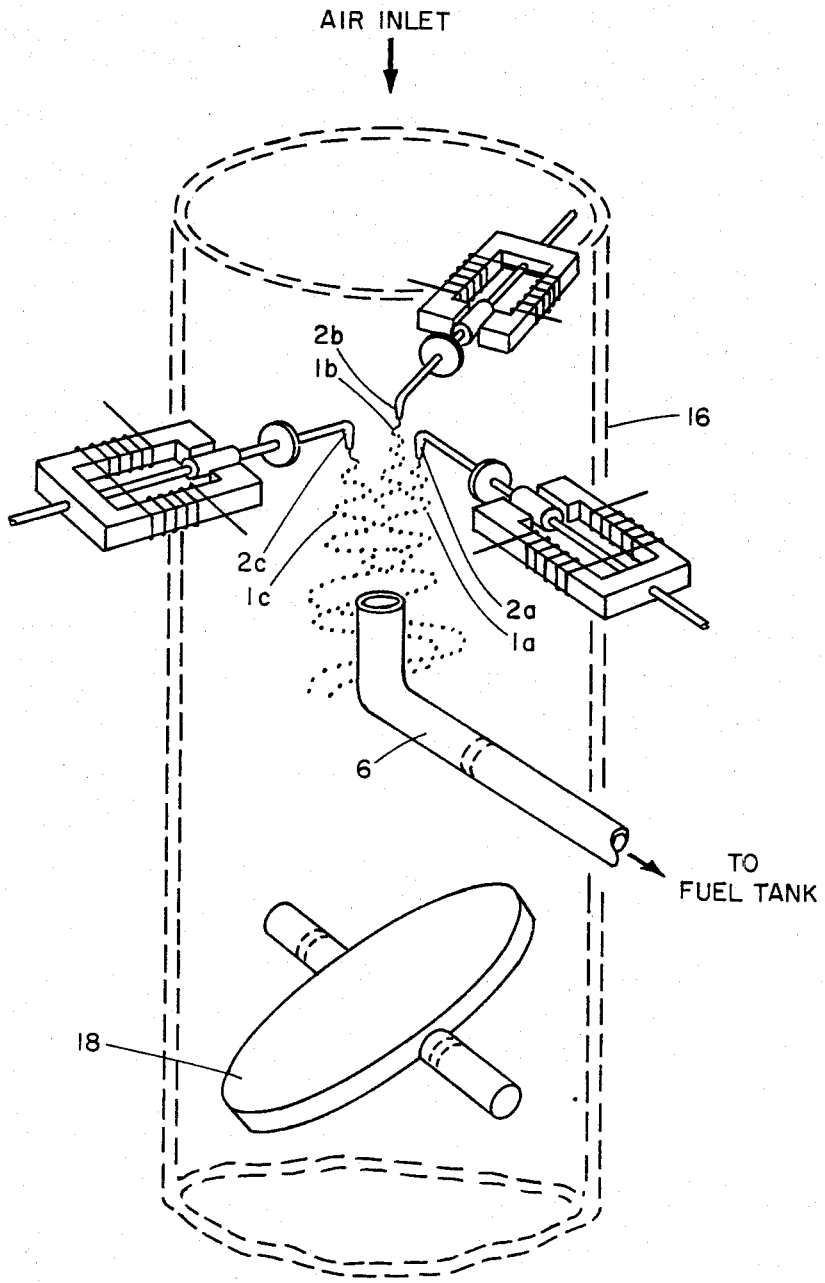
Figure 12:
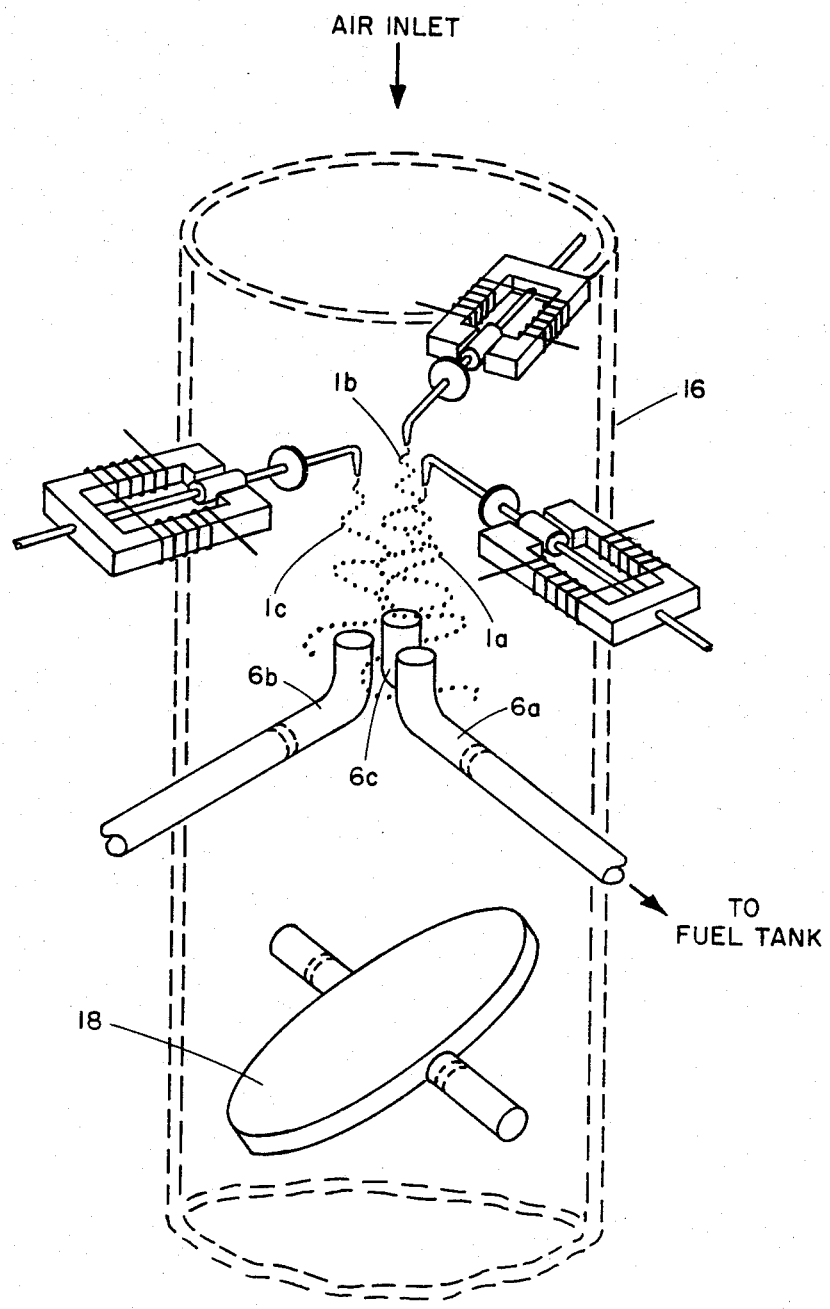

FIG. 11 illustrates a further embodiment of the apparatus of the invention;

FIG. 12 illustrates an embodiment of the apparatus of the invention incorporating plural fuel delivery means and receptors.

DESCRIPTION OF THE PREFERRED EMBODIMENTS

Figure 1A:
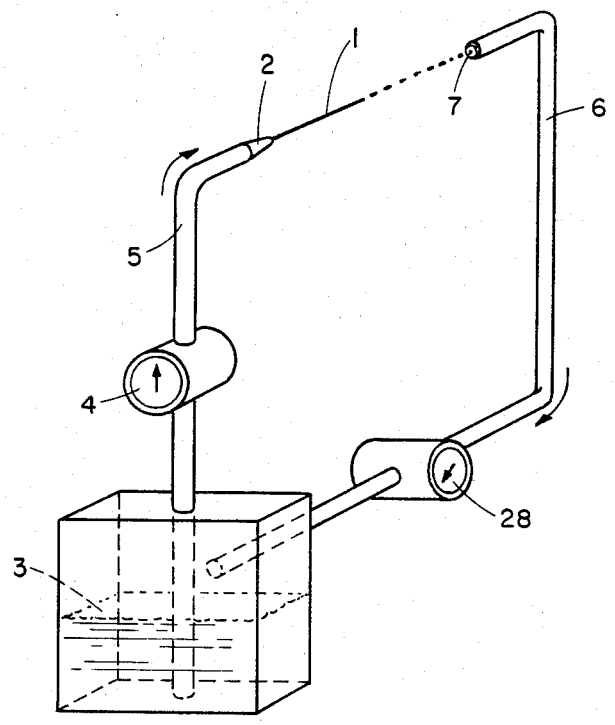
Figure 2:
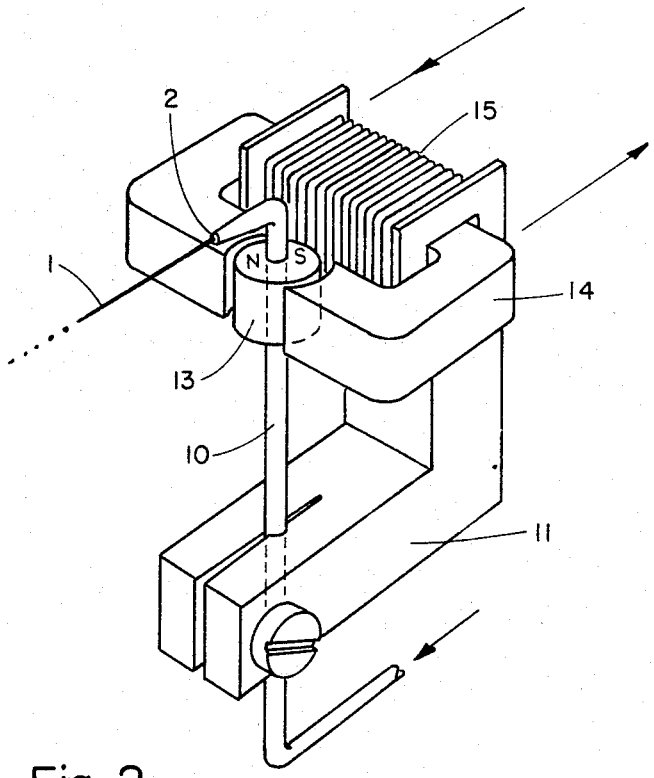

Referring now to FIGS. 1*a* and 2, a jet 1 of fuel issues continually from a nozzle 2. The jet is produced by forcing the fuel from the fuel tank 3 by a pump 4 under high pressure through the fuel supply line 5 and the nozzle 2. A typical value for the nozzle diameter is 1 millimeter and for the pressure 100 kPa, which produces a 1 millimeter in diameter jet travelling at about 10 meters/second. The fuel flow in such a jet is about 35 kg per hour.

About 4 cm in front of the nozzle in the exact direction of the jet axis a tube 6 is placed in a fixed position. The jet will enter this tube through its open end 7 and in this way be returned to the fuel tank 3 through this return tube 6. Thus, as long as the nozzle 2 is not deflected, the fuel will be circulated continuously in the nozzle—return tube—tank circuit by the pump. This return can be aided by a return fuel suction pump 28 in the fuel return tube 6 as indicated in FIG. 1*a*. However, this additional pump 28 can be omitted in most cases since the kinetic energy of the jet itself generates a sufficient driving force inside the return tube 6 to return the fuel to the tank 3.

Figure 1B:
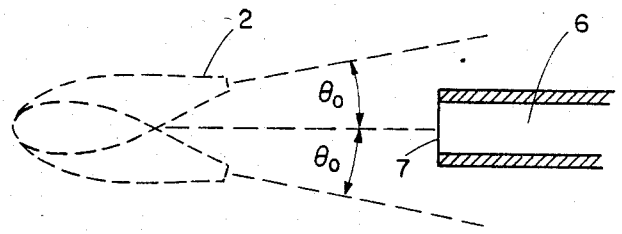

To deflect some of this fuel stream to the outside of the return tube 6 several methods can be used. FIG. 1*b* depicts part of the device shown in FIG. 1*a*, where the nozzle is turned by some external device (not shown) through an angle $\theta_o$ large enough so that the jet misses the entrance 7 (FIG. 1*a*) to the return tube. This will require a relatively large movement of the nozzle which cannot be achieved easily at the speeds and accuracy required by a fuel metering device for an automotive engine. A second method is to deflect the jet by an air stream directed vertically to the jet axis. The same problem occurs in this case as the first method. Another way would be to use the so called split effect described in the U.S. Pat. No. 3,717,875. However, it has been shown that it is difficult to realize a stable split effect reliably. Even electrical methods as described by Sweet in the U.S. Pat. No. 3,596,275 could be considered, which however require vary high electric voltages the use of which is not suitable in connection with a highly flammable gasoline fuel. A novel method has been devised to change the direction of the jet periodically. The method is called the velocity mode method and is described below.

Figure 1C:
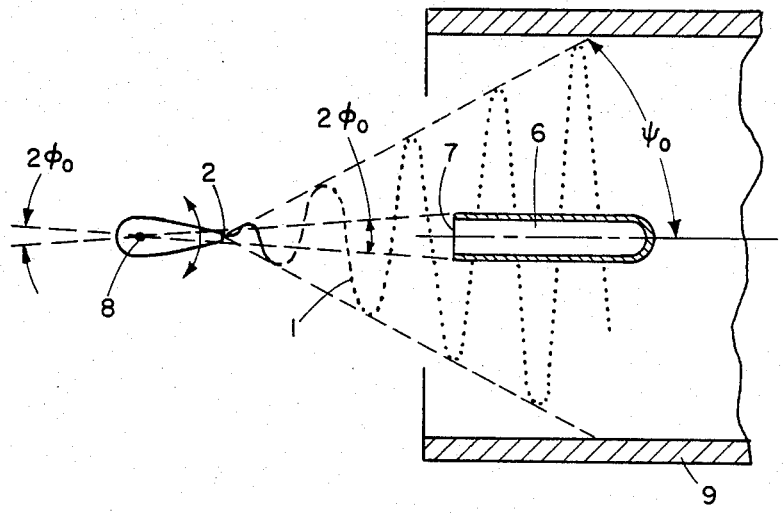

The principle of this novel method is shown in FIG. 1*c*, which again shows the device of FIG. 1*a* from above. Here nozzle 2 is vibrated around its pivot 8 through an angle $\pm\phi_o$, where $\phi_o$ is much less than $\theta_o$ in FIG. 1*b*. If the frequency of vibration is $f=\omega/2\pi$ then $$\phi=\phi_o \sin \omega t$$

where t is the time.

If l is the distance from the pivot 8 to the nozzle 2 for the velocity v of the nozzle 2

$$v = l \cdot \frac{d\phi}{dt} = l \cdot \omega \cdot \phi_o \cos\omega t$$

If c is the speed of the jet, then for the angle $\psi$ of the path of flight of the jet very close to the nozzle 2:

$$\psi = \phi + \text{arc } tg \frac{v}{c} = \phi_o \sin\omega t + \text{arc } tg \frac{l\omega\phi_o \cos\omega t}{c}$$

It can be shown that if c is smaller than $l\omega\phi_o$ the maximum angle $\psi_o$ is much larger than the maximum nozzle movement angle $\Phi_o$ and approximately equal to $$\psi_o = \text{arc } tg \frac{l\ \omega\phi_o}{c}$$

In practice this is true even if $l\omega\phi_o$ is of the same magnitude as c.

From this it is apparent that the maximum angle $\psi_o$ is determined mainly by the jet speed and the velocity of the nozzle. Therefore this method is called velocity mode in the present description. Actually the high velocity of the nozzle is virtually throwing the jet liquid normal to the jet direction thereby generating the large angle $\psi_o$.

In the device according to FIG. 1*c* l=8 mm, $f=\omega/2\pi=2$ kHz and $\phi_o=3$ degrees which gives a maximum throwing angle $\psi_o$ of 28 degrees which is much larger than 3 degrees. Hence the nozzle has to be moved through a very small angle requiring a low driving force which makes this method superior to the methods described earlier.

However, it should be observed that the above calculation is true only if the nozzle oscillates with a constant frequency $f=\omega/2\pi$. In that case the jet 1*a* is thrown out in a snakelike curve as indicated in FIG. 1*c*. From this figure it is obvious that the jet does not enter into the return tube 6 during most of the time. Instead, the part of the jet failing to enter tube 6 is metered out into the air duct 9 leading to the engine manifold.

In the above velocity mode method has been realized by oscillating the nozzle 2 around the pivot 8 as shown in FIG. 1*c*. Obviously the same throwing effect of a fast moving nozzle can be attained by a linear movement or any other fast oscillatory movement of the nozzle.

The velocity mode method has a further advantage over the methods presented earlier. Due to the fast movement of the nozzle, the jet fluid is thrown out with large speed vertically to the jet direction. This results eventually in disrupting the jet into a large number of droplets. This number can be 10 times as large or even greater than the normal drop generation rate observed in linear jets due to Rayleigh's capillary instability. As a result, the drops generated by the velocity mode method are much smaller than expected which is desirable in a fuel metering device for an automotive engine.

As can be concluded from FIG. 1*c*, the amount of the fluid not entering the return tube 6 and thus metered to the engine can be controlled by changing the maximum angle $\Phi_o$ of nozzle excursion. As shown below, this nozzle movement is generated by an electrical AC signal. Hence the amount of fuel metered to the engine can be controlled by controlling the amplitude of this electrical driver signal.

Aside from this amplitude method of fuel metering control there is also the "pulse duration" method. In this method the electrical AC driver signal is switched on and off at regular intervals while its amplitude is constant. In a fuel metering device this is normally done once for each cylinder firing. By changing the duration of this electrical signal the number of oscillations of the nozzle and thus the amount of fuel metered to the engine can be controlled. In between these pulses the nozzle is at rest and the jet 1 enters the return tube 6 and no fuel reaches the engine.

It has been noted that nozzle 2 of the velocity mode metering device should be oscillated in a sinosoidal motion around a pivot point 8 by an electromechanical device. The device can be realized in various ways, some of which will be described here.

A preferred embodiment of such a device is shown in FIG. 2. Here a thin tube of stainless steel 10 is mounted vertically and clamped at its lower end by a fixture 11. At its upper end the tube 10 is bent 90 degrees and terminated by the nozzle 2. Shortly below this bend a cylindrical permanent magnet 13 is attached to the tube 10. The magnet is magnetized normal to its axis in the direction of the nozzle as indicated in FIG. 2. The magnet itself is situated between the poles of an electromagnet 14 and kept in place by two bearings above and below the cylindrical magnet 13 (not shown in the figure). These bearings allow the magnet 13 and nozzle 2 to turn but restrain their movements normal to the axis of the tube 10.

By passing an AC current through the coil 15 of the electromagnet, an alternating torque is set up by the interaction of the electromagnetic field generated by the current and the permanent magnet 13. As a result, the magnet 13 and the nozzle 2 will oscillate with the frequency of the AC driver signal. These angular oscillations will attain their maximum amplitude if the frequency f of the driver signal coincides with the resonance frequency of the mechanical system consisting of the tube 10 and the magnet 13. In this mechanical system the directional moment is due to the torque set up by rotating the tube 10 and the inertia is mainly due to the moment of inertia of the cylindrical magnet 13. A practical value for the resonance frequency of such a system is about 2 kHz.

Figure 3A:
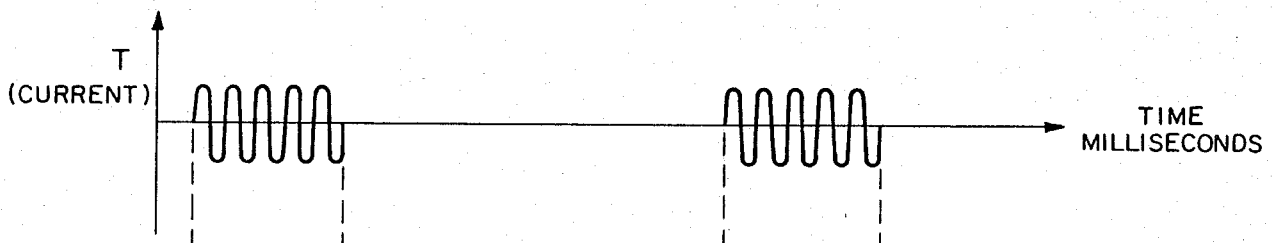

As was explained above, the pulse duration method is a preferred method for a metering device. The device shown in FIG. 2 is energized by a suitable number of current pulses of sinosoidal waves as shown in FIG. 3*a*, the frequency of which coincides with the resonant frequency of the device. For each cylinder firing one such pulse should be generated and its duration will determine the amount of fuel metered out to the engine. Since the pulse duration is typically between 0.5 and 10 milliseconds, a 2 kHz oscillating device can generate between 1 and 20 oscillations for each pulse.

It should be noted that since the oscillating device is driven at its resonance frequency and its Q-valve is relatively high, the nozzle movement does not follow the electrical signal shown in FIG. 3*a* at the start and after the end of the pulse. Instead the nozzle angle follows a path shown approximately in FIG. 3*b*. This figure shows that at the start the nozzle movement increases its amplitude slowly until it attains the final amplitude. Also, after the end of the driving pulse, the mechanical vibrations disappear slowly in an exponential fashion since the dissipation of the mechanical energy stored in the oscillating systems takes some time.

Figure 3B:
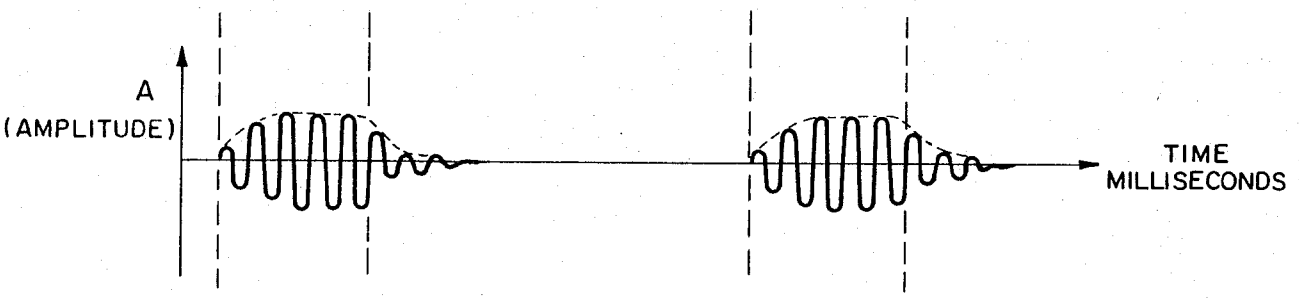
Figure 3C:
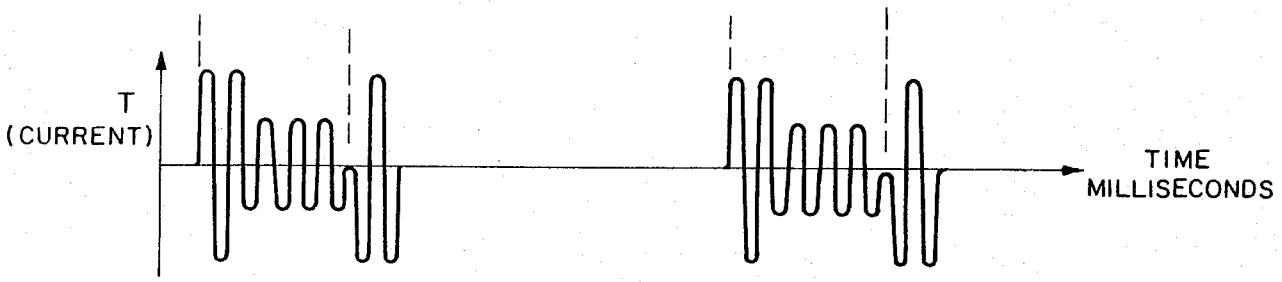

The oscillating motion shown in FIG. 3*b* is not the most preferred way to obtain maximum metering accuracy since slight deviations of the initial and final wave motions will appreciably change the amount of fuel entering the return tube 6. Instead a motion in accordance with the signal shape shown in FIG. 3*a* is most preferable. This can be achieved by increasing the amplitude of the first cycle or cycles in each pulse above normal as exemplified in FIG. 3*c*. The force exerted on the cylindrical magnet 13 is thereby increased which starts its mechanical oscillations immediately. At the end of the pulse, these oscillations can be stopped almost immediately by adding one or two extra cycles of electrical driving current the phase of which is 180° out of phase with the original device current as shown in FIG. 3*c*. Even in this case the amplitude of this stop pulse could be chosen larger than the normal amplitude of the driver signal. Thus by using the driver current pulse shown in FIG. 3*c* or a similar curve form the mechanical motion of the nozzle can be forced to approximate the shape given in FIG. 3*a*. Further, the driving signal does not necessarily have a sine shape. For example, a square wave shape is equally effective since the mechanically oscillating system has a rather small bandwidth and therefore disregards the higher frequency components of the driver signal. Even other signal shapes can be used.

As described above it is preferable for the present metering device to oscillate the nozzle. This can be achieved in various ways the preferred embodiment being described in FIG. 2. In the following, some other methods to oscillate the nozzle are described which will allow the nozzle to be oscillated with an amplitude large enough so that the product of this amplitude A and the angular frequency $\omega$, i.e., $(A.)(\omega)$ is comparable to the velocity c of the jet. Thus the condition for producing a velocity mode method is met by these devices.

A. Vibrating reed energized by AC magnetic field only. This device is shown in FIG. 10*a*, where a steel reed is clamped to one of the poles of a U-formed electromagnet. If an AC current is passed through the core of the electromagnet with a suitable frequency, the reed can be made to oscillate with its free end at which the nozzle generating the fuel jet is situated. The width of the vibrating steel reed should be about 4 mm with a length of about 15–18 mm. This device generates reed vibrations of sufficient amplitude in the frequency range 1-3 kHz and higher. Therefore it can be used in the fuel metering system of the present invention.

B. A vibrating reed placed in an external magnetic DC field and magnetized by an AC current. In FIG. 10*b*, a vibrating reed of steel R (preferably laminated) is clamped at its lower end and protrudes through the center of a coil C into the gap of a permanent magnet N-S. When an AC current is passed through the coil, the upper end of the reed will alternatively become a magnetic north or south pole with the frequency of the current signal. As a consequence of this an alternating force will be exerted on the end of the reed by the DC magnetic field of the permanent magnet. Thus if the frequency of the AC current coincides with the resonant frequency of the reed, reed vibrations of relatively large amplitudes are excited. Again, the nozzle should be attached to the free end of the reed.

Many other methods can be devised to oscillate a nozzle in such a way that the product $\omega$.A becomes comparable to the speed of the jet emerging from the nozzle. Other examples are magnetostrictive devices or bimorph piezoelectric ceramic reeds and similar piezoelectrically powered devices. Thus the above described devices are given only by way of example and do not cover all methods to oscillate a nozzle.

A complete embodiment of a fuel metering device for a gasoline engine using the velocity mode principle described in FIG. 1*c* is shown in the cross-section 4*a* and in the perspective view 4*b*. Here a tube 16 leads the air from the air intake 17 at its upper end to the throttle 18 and from there to the engine manifold (not shown). The fuel jet 1 exits straight into the tube 16 from the nozzle 2 which is oscillated by the magnet 13 when a suitable driver current is passed through the coil 15 of the electromagnet 14. The nozzle 2 is fixed at the end of the steel tube 10 which is clamped in the fixture which keeps the nozzle in the right position relative to the tube 16. Fuel is continuously pumped into this steel tube 10 by the pump 4 from the fuel tank 3. The fixture holding the electromagnet 14 and the bearings keeping the stainless steel tube 10 in position are not shown for clarity. If the nozzle is at rest the jet follows a straight line from the nozzle to the entrance 7 of the return tube 6. It therefore enters continuously into the return tube 6 and is returned to the fuel tank 3. If necessary this return flow can be aided by a suction pump 28 shown in FIG. 1*a*. Hence, if the nozzle is at rest, no fuel enters the engine's manifold chamber.

Figure 4A:
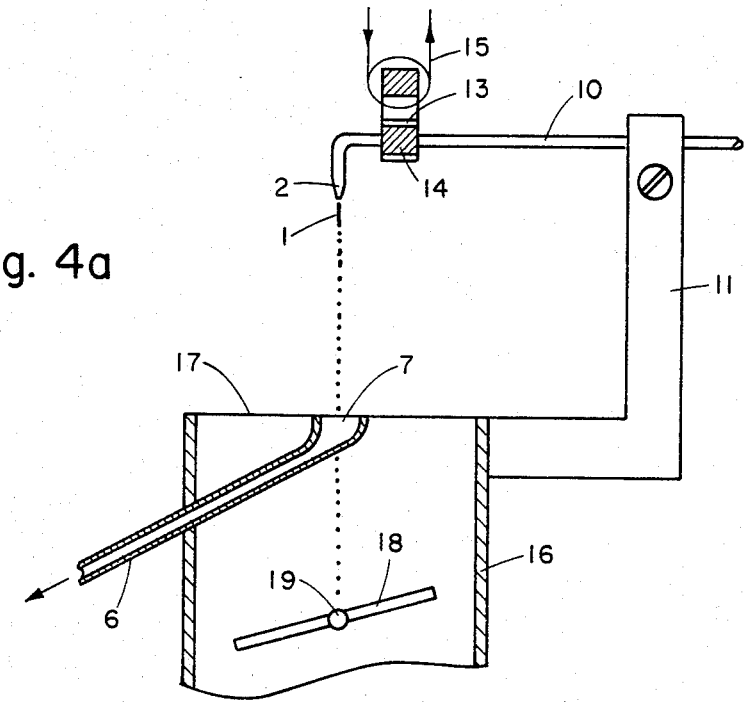
Figure 4B:
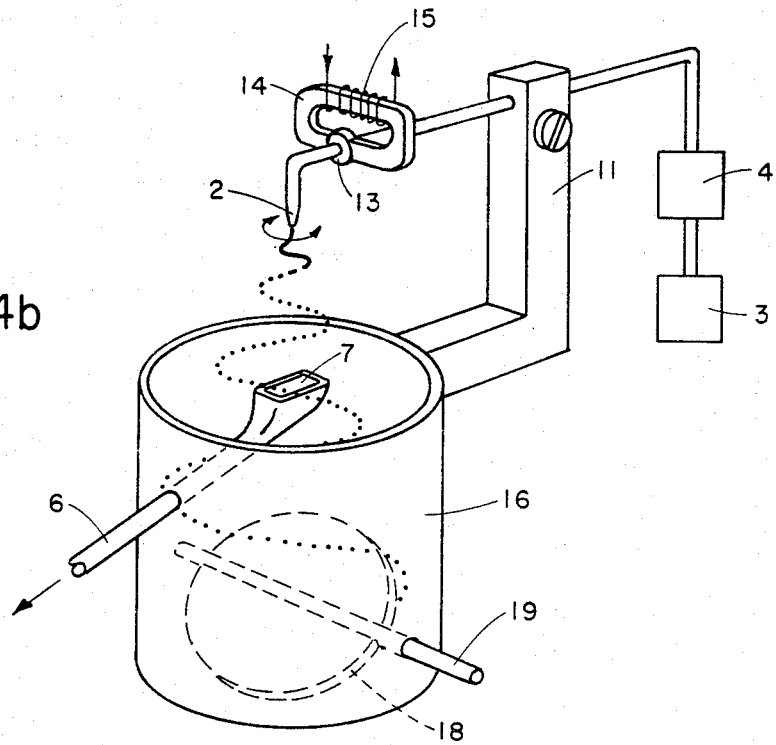

If the nozzle 2 is vibrated at a frequency and amplitude so that the velocity mode is elicited, the jet travels in a snakelike fashion down the tube in the form of small drops as indicated in FIG. 4*b*. Most of these drops fail to enter the return tube 6 and proceed with the air stream past the throttle 18 to the engine through the engine manifold chamber. Thus, by using the pulse duration method described in FIG. 3, the amount of fuel metered to the engine can be controlled by the duration of the driving pulse applied to the electromagnet 14. Alternatively the amplitude metering method can be used.

The direction of the throttle axis 19 relative to the plane of the nozzle oscillations can be chosen arbitrarily. Thus the direction shown in FIG. 4 is only by way of an example. Normally the direction and position of the throttle should be chosen so as to minimize any unequalities in the fuel distribution to the different cylinders of the engine.

Obviously it is also possible to arrange 2 or more oscillating nozzle devices above the air intake tube 16 directing their respective jets into a common return tube as shown in FIG. 11. Alternatively a separate return tube can be provided for each of these jets shown in FIG. 12. This use of several jets is advantageous if one jet alone cannot deliver all the fuel the engine requires at maximum load. Alternatively, if the metering accuracy obtainable with a single jet is not sufficient, i.e., at idling speeds of the engine when very little fuel is required, then two or more nozzles with different nozzle sizes can be provided. In such a case, during idling or at low engine speeds only the nozzle producing the smallest jet is oscillated. Only when the engine at higher speeds and loads requires more fuel than the smallest nozzle can provide, the nozzle with the larger size is also oscillated in such a way that the combined fuel flow metered out from the two vibrating jets meets the requirements of the engine. Both the pulse method of amplitude method of fuel metering described above can be used in these cases.

Obviously it is very important for metering accuracy to maintain a constant amplitude of the nozzle vibrations. This can be achieved by placing a suitable transducer close to the nozzle, which measures the nozzle amplitude and converts it into an electrical signal. This signal can then be used to control the nozzle oscillations by the use of a feed-back loop. Alternatively, the driving current delivered to the electromagnet 14 can be measured and the output from this measurement used to keep the driver current amplitude constant.

In the metering device shown in FIG. 4 the geometry and the position of the return tube entrance 7 is important. The reason for this is the large speed of the air stream through the air tube 16 caused by the strong suction generated by the motor. If the entrance 7 of the return tube 6 is positioned in an unsuitable way, suction may be produced in the return tube by the air rushing past its entrance 7, which causes the fuel to be sucked out of the return tube. To avoid this the geometry and position of the return tube entrance 7 are chosen in such a way that the inrushing air creates an increased pressure in the return tube by a ram effect. This increased pressure not only prohibits fuel from exiting through the entrance 7 into the airflow and eventually into the engine but also helps to drive the fuel in the return tube back into the fuel tank.

The high speed of the air flow in the air intake tube 16 occasioned especially during wide open throttle conditions may disturb the jet appreciably. Thus, if the nozzle is at rest, the jet 1 might no longer follow a straight line into the return tube 6. Instead part of the jet might miss the entrance 7 and proceed to the engine which decreases the metering accuracy of the device. Also, if the nozzle oscillates the air flow might influence the form of the snakelike jet thus changing the amount of fuel metered to the engine.

Figure 5A:
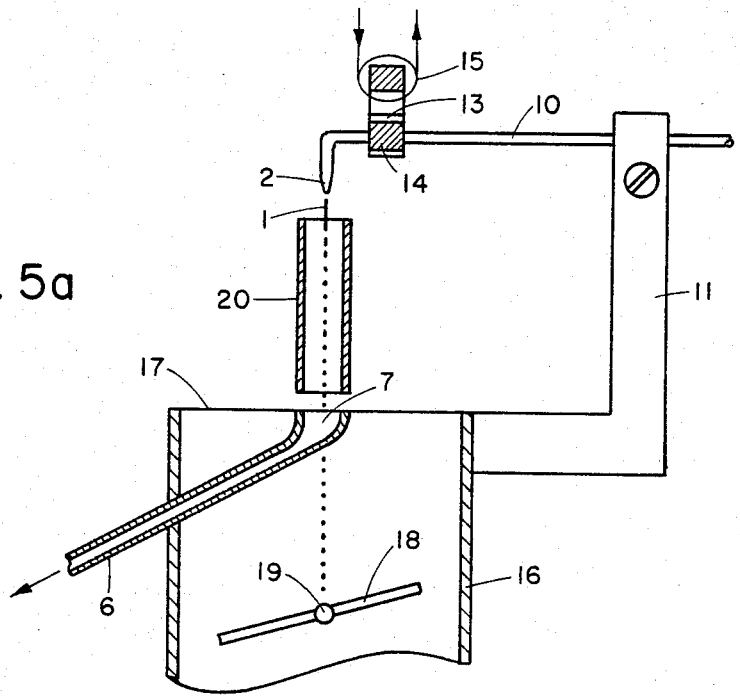
Figure 5B:
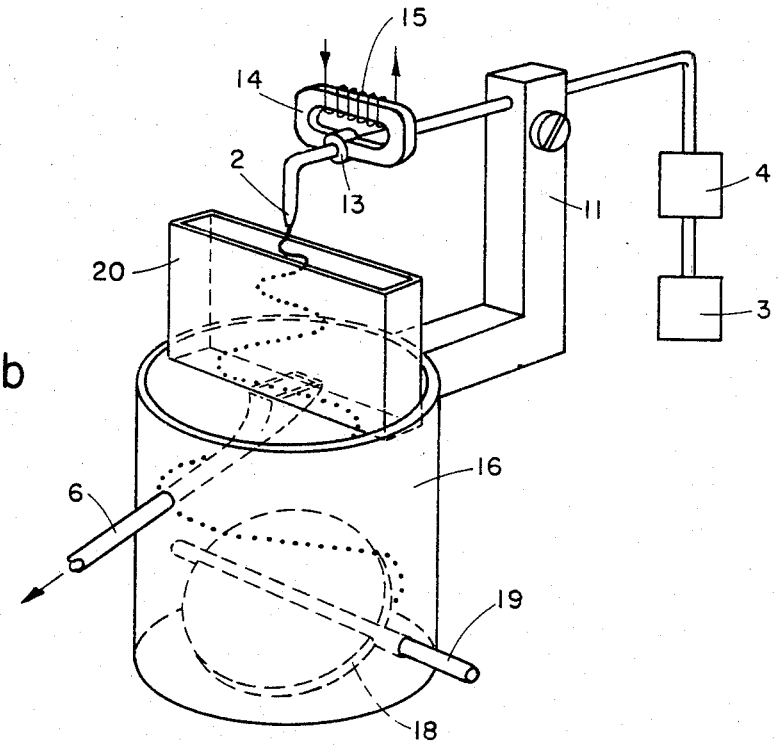

To avoid this influence of the air flow on jet shape a suitable air duct 20 is introduced surrounding the jet path 1 as shown in FIG. 5 which ensures that most of the air required by the engine passes outside duct 20 and the air flow within the duct is essentially laminar.

Figure 6:
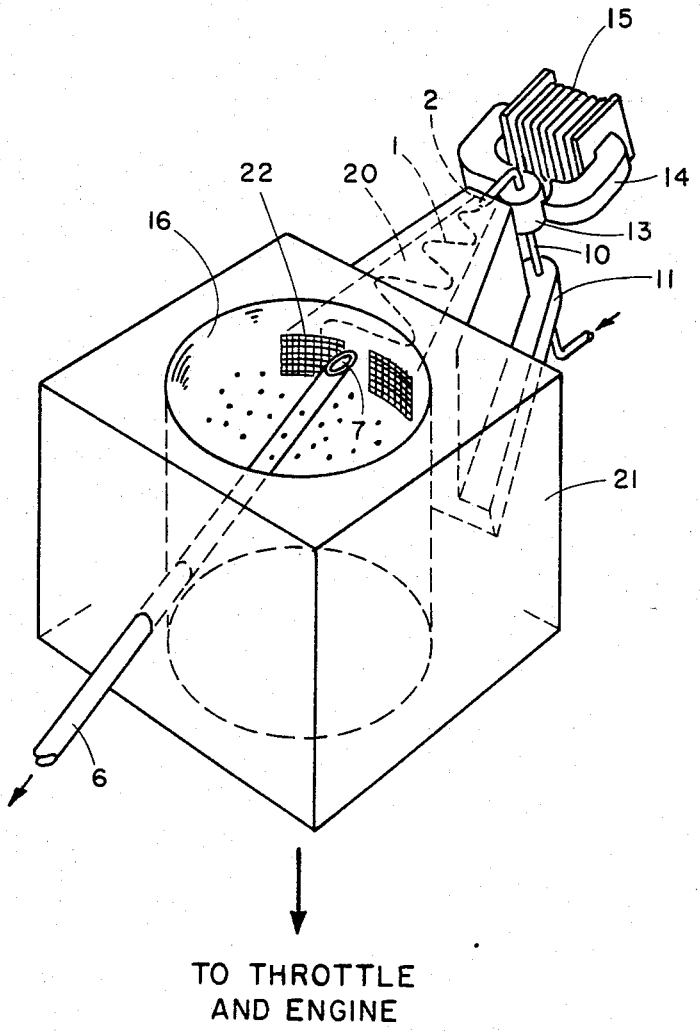
FIG. 6 illustrates a further embodiment of the apparatus of the invention.

FIG. 6 shows a further embodiment of the invention. Here the jet is not introduced essentially parallel to the axis of the air intake tube 16 but rather at an angle to said axis. Suitable angles might lie between 30 and 90 degrees to that axis. This allows the duct 20 to be situated entirely outside the air intake tube 16 thus eliminating the influence of air flow on the jet. Also it ensures a better distribution of the fuel not entering the return tube 6 across the entire cross-section of the air intake tube 16, thus ensuring a more equal distribution of fuel to the different cylinders of the engine. In FIG. 6 the throttle is not shown for clarity, however, it is situated directly under the metering body 21 and in alignment with the air intake tube 16. In this embodiment the angle between the jet direction and the axis 19 of the throttle is not critical and can vary from 0° to 90° or more of the axis of the air intake tube 16. Alternatively, the throttle may be situated above the air intake tube 16 so that the metering device lies between the throttle and the engine manifold.

Further, embodiments of the invention shown in FIGS. 4 and 5, have important advantage over conventional fuel metering devices. It has been pointed out above that it is very important that all cylinders of the engine be supplied with the same maximum efficiency air-fuel ratio of 14.5 to avoid pollution and fuel efficiency losses. This is often difficult to achieve because of the complicated air streams in the manifold which cannot be calculated prior to actually building the carburetor-manifold combination. Therefore correct manifold design can be arrived at only by a trial-and-error method which is expensive. This is not necessary in the present invention since the angle $\psi_o$, of maximum jet deflection (FIG. 1*c*) can easily be adjusted by the control of the current in the coil 15 of the electromagnet 14. Thereby the distribution of the fuel density in the plane of the throttle 18 and thus also at the manifold entrance can be changed without difficulty until a suitable fuel mixture distribution between the cylinders of the engine is determined. Further the angle between the plane of the jet undulations (or nozzle vibrations) and the throttle axis 19, e.g., FIG. 4 can be changed by rotating the metering device compared to the throttle body until a satisfactory distribution is obtained. Thus the present invention makes it much easier to attain a desirable fuel distribution.

When using the invention to meter fuel, it is desirable that such fuel enters the cylinders of the engine as a very fine mist or even in gaseous form. This is readily attained if the fuel is introduced into the air stream transversing the metering device in the form of fine drops. This is accomplished to a reasonable degree by the present invention which is another of its advantages over conventional fuel metering devices. However, the drops generated by the embodiments described in FIGS. 4 and 5 might be split into even finer droplets by a simple device as described in the following.

As described above the jet 1 normally has an appreciable speed i.e., about 10 meters/second. Therefore, the drops generated by the oscillation of the jet have a similar speed. If these drops hit a fine mesh screen with this speed, they are broken up into even finer drops when they traverse the mesh screen.

Such a mesh screen can easily be introduced in the embodiments of the invention described in FIG. 5. As an example, FIG. 6 shows a mesh screen 22 attached to the inner wall of the air duct 16 covering all of the exit of the duct 20 from the nozzle 2 to the air duct 16 except for the entrance 7 to the return tube 6. In that way all the drops of the jet that enter the air duct 16 are broken up into much smaller drops except those that enter the return tube. At the same time their speed is reduced so that they can be carried away by the air stream into the engine more efficiently.

Preferably the mesh screen should be made of metal wire mesh with about 2–5 wires per millimeter, but also wider or smaller mesh sizes can be used. Alternatively a small slit may be used instead of the mesh screen. In the embodiment shown in FIG. 5 the mesh screen is attached to the lower opening of the duct 20 where the jet exits into the air tube 16. However, the mesh may be positioned at other places along the jet path.

As described above the undeflected jet enters the return tube 6 with an appreciable speed. In this process a certain amount of air is entrapped and carried away together with the fuel into the tank. If the tank is hermetically closed a pressure is slowly generated in the tank which eventually could impede the fuel flow in the return tube.

Most of the tanks in automobiles are equipped with some kind of small leak or valve to the outside air, so that the tank pressure is at or close to ambient air pressure. Thus the air returned to the tank by the return tube 6 can escape through that leak. However, since gaseous fuel (hydrocarbons) is mixed with such escaping air, this can cause the outside air to become polluted with hydrocarbons.

This pollution can be avoided if the air space in the tank is connected by a tube 23 to a section of the air duct 16 above or below the throttle 18 as indicated in FIG. 8 where 24 is the metering device described in FIGS. 4, 5, and 6. In this case a negative pressure is generated in the tube 23 and the tank 3 when engine 25 is running. In this way the gaseous hydrocarbons in the tank 3 are automatically returned to the engine where they ignite and burn together with the normal fuel.

Figure 7:
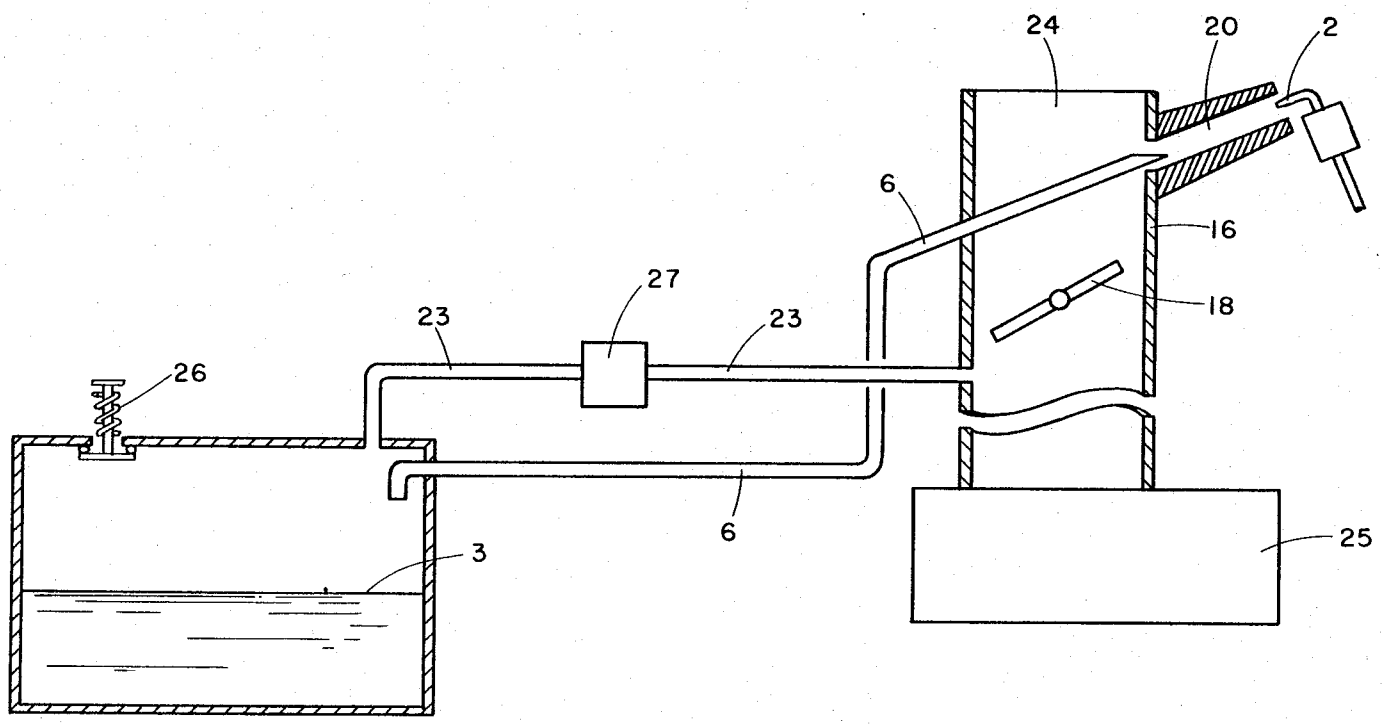
FIG. 7 is a simplified cross-sectional view of an embodiment of the present invention adapted to accurately meter amounts of liquid fuel and return gaseous fuel.

Depending on the status of the running engine the negative pressure generated in tube 23 can vary widely. As a result, pressure in the tank 3 can become lower than is acceptable for structural and other reasons (the tank might collapse). This can be avoided in two different ways as indicated in FIG. 7. A spring loaded check-valve 26 is shown on the top of tank 3 which opens at a pre-set negative pressure in tank 3 to admit air thereby relieving the pressure. If this results in a too large or uncontrollable shunt air stream through the tube 23 to the main air stream to the engine, a pressure regulated needle valve 27 can be inserted in tube 23 which opens only if the pressure generated in the tank 3 exceeds atmospheric pressure. Both methods will ensure that the pressure above the fuel in the tank 3 will remain close to the ambient air pressure.

While the description set forth above particularly focuses on a periodically oscillating nozzle, a stationary nozzle can be used which directs its jet towards the return tube 6. By touching the jet a few millimeters in front of this stationary nozzle by an electrically controllable arm, rod, or deflector, the direction of the jet can be changed so that is fails to enter the return tube.

Figure 9A:
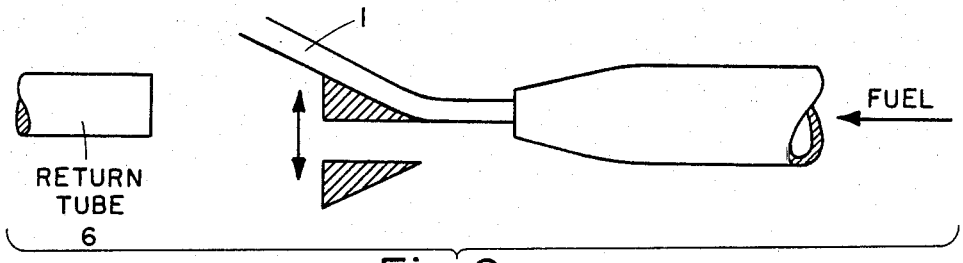
Figure 9B:
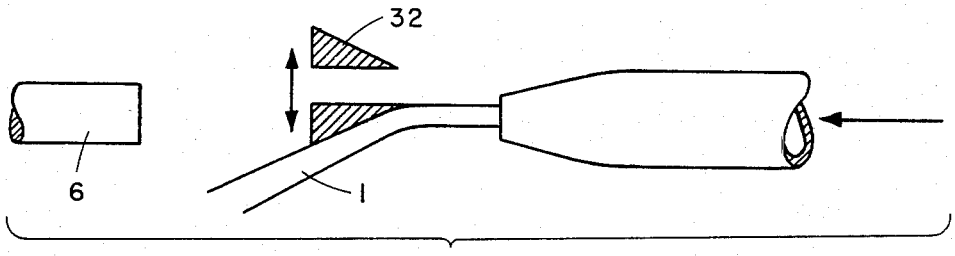
Figure 9C:
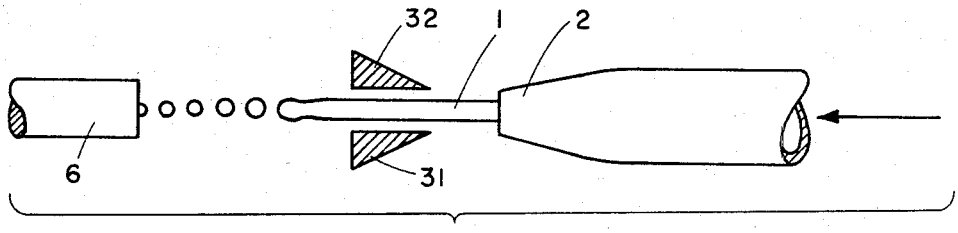
Figure 9D:
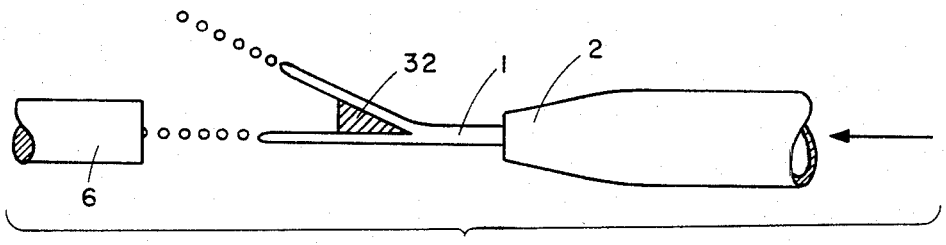

This principle can be realized in different ways, one of which is shown in FIG. 8. Here the jet 1 passes through the two prongs 28 and 29 of a fork 30 without touching the prongs as indicated in FIG. 9*c*. The fork 30 is attached to an oscillating device consisting of the permanent magnet 13 between the poles of the electromagnet 14.

By passing an AC current of suitable frequency through the electromagnet, the fork 30 begins to oscillate thereby touching the sides of the jet 1. As shown in FIGS. 8*a* and 8*b*this immediately leads to a large deflection of the jet even if the jet is only slightly indented by the prong of the fork. As a result of this the jet does not enter the return tube but is deflected into the air intake duct 16 leading to the engine (not shown in FIGS. 8*a–c*).

The strong deflection effected by only a light touch of one of the prongs 28 and 29 to the jet can be explained by the well known Coanda effect. If a jet of fluid touches a solid surface because of the Coanda effect, the jet follows the curvature of the surface for some length before is disengages again from the surface. As a result of this the jet direction is altered, depending on the shape of the surface. In this embodiment the prongs are cylindrical and the jet direction is altered as indicated in FIGS. 8*a* and 8*b*. Other cross-sectional shapes can be used for the prongs.

Alternatively only one prong need be used. Also, the prongs do not have to be oscillated but just moved in and out of the jet in a suitable time sequence by electrical pulses applied to the electromagnet 14. In such a case, the length of each of these pulses will determine the time period during which the jet is deflected. Since only very small movements e.g. less than 0.1 mm are necessary to engage the prong to the jet or disengage it again, this can be achieved at high speeds so that fuel metering pulses as short as 1 ms can be generated.

Alternatively the prongs of the fork 30 can be shaped like real deflector plates as indicated in FIG. 9. Again the jet 1 can pass between the prongs 31 and 32 when the fork is at rest as shown in FIG. 10*c*. If the fork is moved somewhat more than the jet diameter, the jet is deflected by the triangle formed deflection prongs 31 or 32. Also a partial deflection of the jet can be effected by the sharp leading edge of the prongs 31 or 32, which will split the jet as indicated in FIG. 10*d*. Even these jet deflections can be caused by a single prong. Again the prong or prongs might oscillate or move in a discontinuous fashion in and out of the jet as described above.

In the devices described in FIGS. 8 and 9 the fork or a single prong must be moved or oscillated. This can be achieved by a device similar to the one described in FIG. 2 but also other electromagnet devices capable of moving small mechanical structures back and forth at high speeds can be used.

While the present invention is mainly described as a fuel metering device for gasoline engines, it is obvious that the principle as well as the embodiments described here or parts of them can also be used to meter other fluids in other type applications.

It is also obvious that the fuel metering device the principle of which is shown in FIG. 1*c* may be located entirely outside the air duct 16 leading the air to the cylinders of a gasoline engine. In that case the oscillating nozzle 2 and the return tube 6 are located in a separate compartment. If the bottom of this compartment is connected to the air duct by a small hole the fuel metered outside the return tube will be transferred into the air duct and engine by suction through that hole. This method is especially advantageous if the fuel is to be metered into the air flow between the throttle 18 and the engine.

I claim:

1. A fuel supply control system for an internal combustion engine said engine having at least one cylinder and operable in conjunction with apparatus to control the flow of air to each of said cylinders comprising:

a. means connectable with said air control apparatus for regulating the flow of air to said engine;

b. at least one chamber being in fluid communication with each of said at least one cylinder;

c. fuel delivery means terminating in an aperture such that said fuel, when forced through said aperture forms a continuous stream;

d. pump means adapted to transfer said fuel under pressure from a reservoir through said fuel delivery means thereby forming said continuous stream;

e. control means adapted to control the direction of flow of said continuous stream and to impart to said continuous stream a controlled periodic oscillation and adapted to control the amplitude of said periodic oscillation;

f. receptor means in said at least one chamber for receiving at least a portion of the continuous stream of fuel.

2. The fuel supply control system in accordance with claim 1 wherein said receptor means is situated between said fuel delivery means and said at least one cylinder.

3. The fuel supply control system in accordance with claim 1 wherein said at least one cylinder is situated between said fuel delivery means and said receptor means.

4. The fuel supply control system in accordance with claim 1 wherein said control means comprises an electric signal generating means.

5. The fuel supply control system in accordance with claim 4 wherein said electric signal generating means comprises an alternating voltage or an alternating current signal.

6. The fuel supply control system in accordance with claim 5 wherein the amplitude of said signal is not held constant.

7. The fuel supply control system in accordance with claim 5 wherein said signal is turned off at regular intervals and the amplitude of said signal is held constant.

8. The fuel supply control system in accordance with claim 1 wherein said aperture further comprises a pivot means.

9. The fuel supply control system in accordance with claim 8 wherein said pivot means pivots about a point through a total angle not greater than 45° from the axis of a line drawn through said aperture.

10. The fuel supply control system in accordance with claim 8 wherein said angle is not greater than 3°.

11. The fuel supply control system in accordance with claim 8 wherein said pivot means comprises a permanent magnet.

12. A fuel supply control system in accordance with claim 11 wherein said control means comprises an electromagnet, whereby the magnetic field generated by said electromagnet interacts with the magnetic field of the permanent magnet causing periodic oscillation of said permanent magnet.

13. The fuel supply control system in accordance with claim 1 wherein said period oscillation causes said continuous stream to sinusoidally diverge from its axis.

14. The fuel supply control system in accordance with claim 1 wherein said aperture further comprises means to linearly oscillate said aperture through a line drawn axially through said aperture.

15. The fuel supply control system in accordance with claim 1 wherein said aperture further comprises a vibrating reed.

16. The fuel supply control system in accordance with claim 1 wherein said fuel delivery means terminates in a plurality of apertures having substantially identical diameters.

17. The fuel supply control system in accordance with claim 16 wherein said receptor means comprises a single tube for receiving said at least a portion of the continuous stream of fluid from said plurality of apertures.

18. The fuel supply control system in accordance with claim 16 wherein said receptor means comprises multiple tubes for receiving said at least a portion of the continuous stream of fuel from said plurality of apertures.

19. The fuel supply control system in accordance with claim 1 wherein said fuel delivery means terminates in a plurality of apertures having different diameters.

20. The fuel supply control system in accordance with claim 19 wherein said receptor means comprises a single tube for receiving said at least a portion of the continuous stream of fluid from said plurality of apertures.

21. The fuel supply control system in accordance with claim 19 wherein said receptor means comprises multiple tubes for receiving said at least a portion of the continuous stream of fuel from said plurality of apertures.

22. The fuel supply control system in accordance with claim 4 wherein said electric generating means comprises a transducer.

23. The fuel supply control system in accordance with claim 1 wherein said at least a portion of the continuous stream combines with said flow of air to said engine, said continuous stream movement being essentially parallel to said flow of air.

24. The fuel supply control system in accordance with claim 23 wherein said at least a portion of the continuous stream is formed into drops by passing through a screen prior to combining with said flow of air.

25. The fuel supply control system in accordance with claim 1 wherein said at least a portion of the continuous stream combines with said flow of air to said engine, said continuous stream movement being at an angle to said flow of air.

26. The fuel supply control system in accordance with claim 25 wherein said at least a portion of the continuous stream is formed into drops by passing through a screen prior to combining with said flow of air.

27. The fuel supply control system in accordance with claim 1 wherein said reservoir is connected to said receptor means so as to return to said reservoir said at least a portion of the continuous stream of fuel.

28. The fuel supply control system in accordance with claim 27 wherein pressure within said reservoir is maintained below ambient air pressure.

29. The fuel supply control system in accordance with claim 27 wherein said connection includes a second pump means to transfer said at least a portion of the continuous stream to fuel of said reservoir.

30. The fuel supply control system in accordance with claim 1 wherein said continuous stream impacts said control means.

31. The fuel supply control system in accordance with claim 12 wherein said period oscillation of said permanent magnet is the resonance frequency, said resonance frequency being substantially the same as an alternating current signal driving said electromagnet.

* * * * *